US010749262B2

(12) United States Patent
McGrath et al.

(10) Patent No.: US 10,749,262 B2
(45) Date of Patent: Aug. 18, 2020

(54) TAPERED SLOT ANTENNA INCLUDING POWER-COMBINING FEEDS

(71) Applicant: Raytheon Company, Waltham, MA (US)

(72) Inventors: Daniel T. McGrath, McKinney, TX (US); Brian W. Johansen, McKinney, TX (US); Michael C. Streitwieser, McKinney, TX (US)

(73) Assignee: RAYTHEON COMPANY, Waltham, MA (US)

( * ) Notice: Subject to any disclaimer, the term of this patent is extended or adjusted under 35 U.S.C. 154(b) by 227 days.

(21) Appl. No.: 15/896,668

(22) Filed: Feb. 14, 2018

(65) Prior Publication Data

US 2019/0252787 A1 Aug. 15, 2019

(51) Int. Cl.

| | |
|---|---|
| ***H01Q 13/08*** | (2006.01) |
| ***H01Q 21/06*** | (2006.01) |
| ***H01Q 1/50*** | (2006.01) |

(52) U.S. Cl.

CPC ..... *H01Q 13/085* (2013.01); *H01Q 1/50* (2013.01); *H01Q 21/064* (2013.01)

(58) Field of Classification Search

CPC ..... H01Q 1/38; H01Q 13/085; H01Q 13/18; H01Q 21/064

See application file for complete search history.

(56) References Cited

U.S. PATENT DOCUMENTS

| | | | | |
|---|---|---|---|---|
| 4,360,813 | A | 11/1982 | Fitzsimmons | |
| 5,541,611 | A | 7/1996 | Peng et al. | |
| 5,949,382 | A | 9/1999 | Quan | |
| 5,973,653 | A | 10/1999 | Kragalott et al. | |
| 6,127,984 | A * | 10/2000 | Klebe | H01Q 13/08 343/767 |
| 6,356,240 | B1 | 3/2002 | Taylor | |
| 7,652,631 | B2 | 1/2010 | McGrath | |
| 8,259,027 | B2 | 9/2012 | Isom et al. | |
| 8,314,750 | B1 | 11/2012 | Josypenko | |
| 2011/0001679 | A1 * | 1/2011 | Meharry | H01Q 13/08 343/859 |

FOREIGN PATENT DOCUMENTS

EP 1088368 B1 8/2003

OTHER PUBLICATIONS

International Search Report and Written Opinion for PCT/2019/017595, filed Feb. 12, 2019; dated Aug. 6, 2019 (21 pages).

(Continued)

*Primary Examiner* — Daniel Munoz

(74) *Attorney, Agent, or Firm* — Cantor Colburn LLP

(57) ABSTRACT

An antenna transmission system includes a dual-feedline tapered slot antenna configured to generate a radiated output signal in response to a radio frequency (RF) signal. A power divider is configured to split a source RF signal into a plurality of RF feed signals. A plurality of transmitting amplifiers convert the plurality RF feed signals into a plurality of amplified RF feed signals; and a plurality of feedlines deliver the plurality of amplified RF feed signals to the dual-feedline tapered slot antenna. The dual-feedline tapered slot antenna generates the radiated output signal in response to the plurality of amplified RF feed signals.

19 Claims, 4 Drawing Sheets

(56) References Cited

OTHER PUBLICATIONS

Schaubert, "Endfire Slotline Antennas", Proceedings Journees Internationales de Nice sur les ANtennes, Nov. 1990, pp. 253-265.
Ghazali et al., "3D Printed Metalized-Polymer UWB High-Gain Vivaldi Antennas", IEEE MTT-S International Microwave Symposium Proceedings, 2016.
Holter et al., "Experimental Results of 144-Element Dual-Polarized Endfire Tapered-Slot Phased Arrays", IEEE Transactions on Antennas and Propagation, Nov. 2000, pp. 1707-1781.
Partial International Search for International Application No. PCT/US2019/017595, filed Feb. 12, 2019; dated Apr. 23, 2019 (14 pages).

* cited by examiner

TAPERED SLOT ANTENNA INCLUDING POWER-COMBINING FEEDS

BACKGROUND

The subject matter disclosed herein relates to antennas, and more particularly, to tapered slot antennas.

Tapered slot antennas can be used to transmit wideband microwave signals. Conventional tapered slot antennas (also referred to as flared notch antennas or Vivaldi antennas), include a slot transmission line with stepped or flared openings. The slot transmission line is typically excited by a radio frequency amplifier which outputs a signal that is carried by a single antenna feedline such as, for example, a coaxial waveguide. To facilitate use at high power levels, the feedline (e.g., the coaxial waveguide) is typically oriented such that it initiates a point perpendicular to the slotline, and ends at a point at the slotline base. The coaxial outer conductor ends at one side of the slotline, and the coaxial center conductor extends across the slotline, bridging the gap. The outer and center conductors are electrically connected to the conductors forming opposite sides of the slotline. This arrangement requires all of the transmitter power to be carried in a single waveguide having an excessively large diameter.

BRIEF DESCRIPTION

According to at least one non-limiting embodiment, an antenna transmission system includes a dual-feedline tapered slot antenna configured to generate a radiated output signal in response to a radio frequency (RF) signal. A balun is configured to split a source RF signal into a plurality of RF feed signals. A plurality of transmitting amplifiers convert the plurality of RF feed signals into a plurality of amplified RF feed signals; and a plurality of feedlines deliver the plurality of amplified RF feed signals to the dual-feedline tapered slot antenna. The dual-feedline tapered slot antenna generates the radiated output signal in response to the plurality of amplified RF feed signals.

According to another non-limiting embodiment, a dual-feedline tapered slot antenna comprises a first flared conductor and a second flared conductor separated from the first flared conductor by a slot region. A first feedline receptacle is configured to receive a first feedline, and deliver a first RF feed signal to the dual-feedline tapered slot antenna. The dual-feedline tapered slot antenna further includes a second feedline receptacle configured to receive a second feedline, and deliver a second RF feed signal to the dual-feedline tapered slot antenna. A nominal impedance of the slotline region is about one half the nominal impedance of the first and second feedlines.

According to another non-limiting embodiment, a method of transmitting a signal from a dual-feedline tapered slot antenna comprises generating, via a signal source, a radio frequency (RF) signal, and splitting the RF signal into a first feed signal and a second feed signal. The method further comprising amplifying the first feed signal to generate a first amplified feed signal, and amplifying the second feed signal to generate a second amplified feed signal. The method further comprises delivering the first and second amplified feed signals to the dual-feedline tapered slot antenna, combining the first and second amplified feed signals to electrically energize the dual-feedline tapered slot antenna and transmit the signal.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed system, apparatus and method are presented herein by way of exemplification and not limitation with reference to the Figures.

A typical individual slot antenna includes a pair of flared conductors separated by a slot that opens progressively to a radiating mouth. Each flared conductor has a horizontal dimension which decreases progressively in length from the lower end (i.e. base) of the flared conductor to the upper end thereof (i.e., the tip). The base of the flared conductors are spaced apart a small distance from each other by a slotline (also referred to as a slotline gap), while their tips are spaced a larger distance from each other, thereby forming the tapered slot between the two flared conductors.

A conventional tapered slot antenna configures only a single feed line to carry the input signal. For example, a signal generated by a signal source is delivered to a single feedline such as a coaxial waveguide, which is recessed into the base of only one of the flared conductors. The coaxial waveguide includes a center conductor that is surrounded by an outer conductor, and an intermediate dielectric layer that insulates the center conductor from outer conductor. The outer conductor is electrically connected to one flared conductor, and terminates on the near side of the slotline. The center conductor extends across the slotline gap and connects to the opposing flared conductor. As the power handled by the coaxial waveguide increases, the intermediate dielectric layer may begin to breakdown. To support progressively higher power requires increasing the waveguide radius. However, increasing the coaxial waveguide radius to excessive dimensions, or beyond a critical radius can cause degradation to signal quality.

Various non-limiting embodiments described herein provide a tapered slot antenna including dual power-combining feedlines. Thus, unlike conventional tapered slot antennas having only a single feedline, at least one embodiment implements two individual feedlines (e.g., two individual coaxial waveguides) in a single tapered slot antenna. In addition, at least one embodiment selects slotline dimensions of a tapered slot antenna so that the characteristic impedance of the antenna is one half that of two individual coaxial waveguides.

Figure 1:
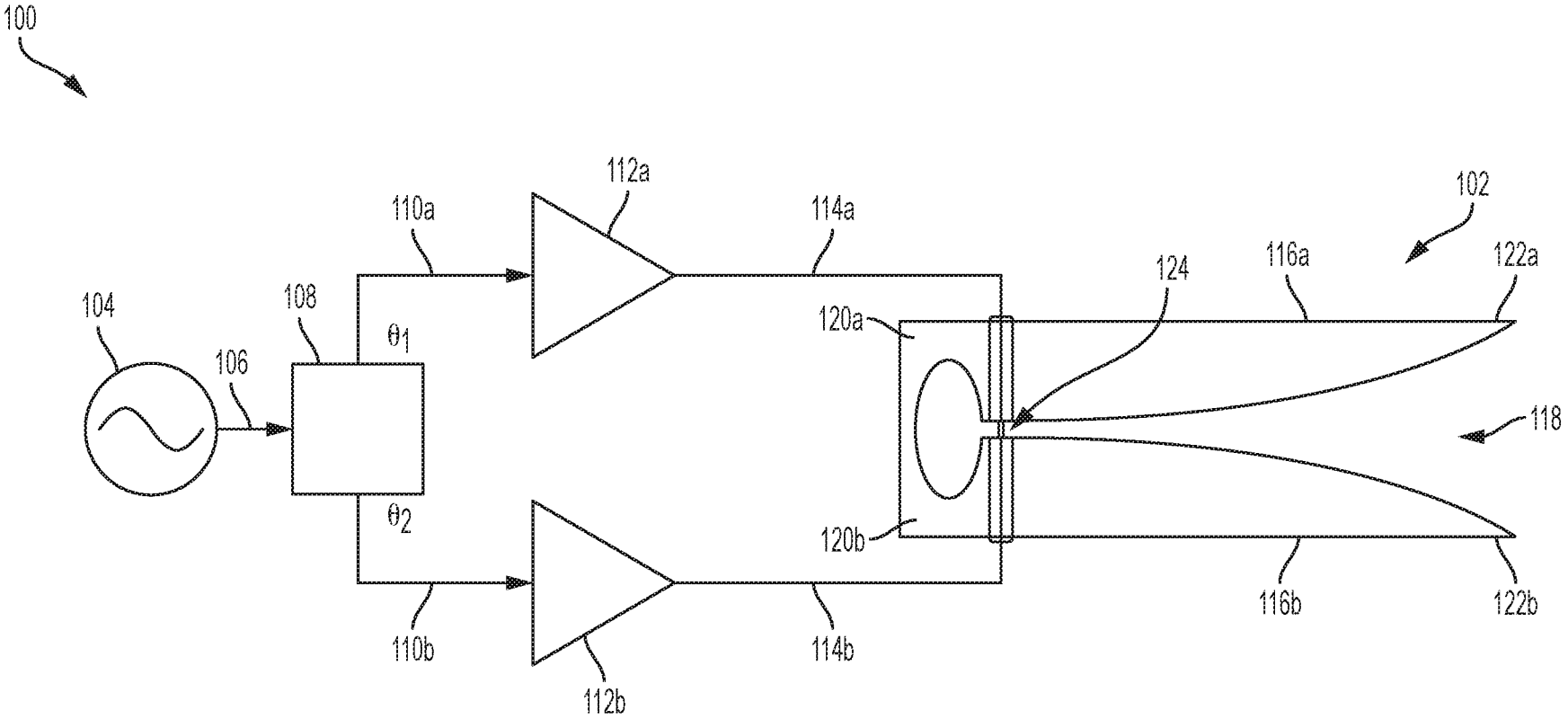
FIG. 1 illustrates an antenna transmission system including a dual-feedline tapered slot antenna according to a non-limiting embodiment.

With reference now to FIG. 1, an antenna transmission system 100 including a dual-feedline tapered slot antenna 102 is illustrated according to a non-limiting embodiment. The antenna transmission system 100 implements a signal source 104 to generate a signal 106. The signal 106 is divided using a power divider device such as a balun 108, for example, so that the two signals 110*a* and 110*b* are approximately equal in power and approximately 180 degrees out-of-phase. The two signals are amplified by the amplifiers 112*a* and 112*b*, then delivered to the dual-feedline tapered slot antenna 102, which radiates an electromagnetic field, which can serve as a radiated output signal.

The dual-feedline tapered slot antenna 102 is in signal communication with the plurality of feedlines to receive the amplified RF feed signals from the plurality of transmitting amplifiers 112*a* and 112*b*. The dual-feedline tapered slot antenna 102 includes a pair of flared conductors 116*a* and 116*b* composed of an electrically conductive material such as metal, for example. A slotline gap 124 is interposed between the 1 the pair of flared conductors 116*a* and 116*b*. In at least one embodiment, the dimensions of the slotline gap 124 are chosen so that its characteristic impedance is one half that of the feedlines (e.g. coaxial waveguides) 114*a* and 114*b*. More generally, for N separate coaxial waveguides with characteristic impedance $Z_0$, the dimensions of the slotline gap 124 are selected to achieve a slotline impedance of $Z_0/N$.

The slotline gap 124 can also be filled with a dielectric material having a high breakdown strength (not shown in FIG. 1). In high-power applications, for example, the slotline gap can be filled (either partially or fully) with a solid dielectric insulator or filler having a breakdown strength that is higher than that of air. Example materials with high breakdown strength and low radio frequency loss are Polytetrafluorethylene, Cyanate-Ester, Rexolite (cross-linked polystyrene and divinyl Benzene) and Polyetherimide.

The antenna transmission system 100 operates to deliver a balanced combination of the first and second RF feed signals 110*a* and 110*b* to the dual-feedline tapered slot antenna 102. That is, the plurality of RF feed signals are delivered to the dual-feedline tapered slot antenna 102 having the same, or approximately the same, amplitude, and either a matching phase, or mismatched phase, based on the direction of the feedlines 114*a* and 114*b* input to the dual-feedline tapered slot antenna 102. If the signals are not balanced, there will be reflection back into the transmitting amplifiers 112*a* and 112*b*.

Still referring to FIG. 1, the first flared conductor 116*a* receives a first feedline 114*a* and the second flared conductor 116*b* receives a second feedline 114*b*. Accordingly, the first and second feedlines 114*a* and 114*b* are fed to the dual-feedline tapered slot antenna 102 in opposite directions (see FIG. 1). In this example, the first and second feedlines 114*a* and 114*b* each have a characteristic impedance of 50 Ohms (50Ω). The slotline 124 has a characteristic impedance of 25Ω. Since the feedlines 114*a* and 114*b* will not be impedance-matched to the slotline, portions of the signals they carry will be reflected from the junction 124 back towards the amplifiers 112*a* and 112*b*. However, approximately equal portions of out-of-phase signals are cross-coupled between feedlines, 114*a* to 114*b* and vice-versa, and cancel the reflected portions.

In another embodiment, either the first flared conductor 116*a* or the second flared conductor 116*b* receives both of the first feedline 114*a* and the second feedline 114*b*. Accordingly, the first and second feedlines 114*a* and 114*b* are fed to the dual-feedline tapered slot antenna 102 in the same direction (not shown in FIG. 1). In this scenario, the first and second feed lines 114*a* and 114*b* are delivered to the dual-feedline tapered slot antenna 102 with the same, or approximately the same, phase, thereby achieving the same signal reflection cancellation effect described above. In this scenario, 108 is an equal-phase, equal-amplitude power divider instead of a balun. Although a tapered antenna designed is described in detail above, it should be appreciated that the aforementioned descriptions can be implemented with other antenna designs including, but not limited to, a stepped-slot antenna.

Figure 2:
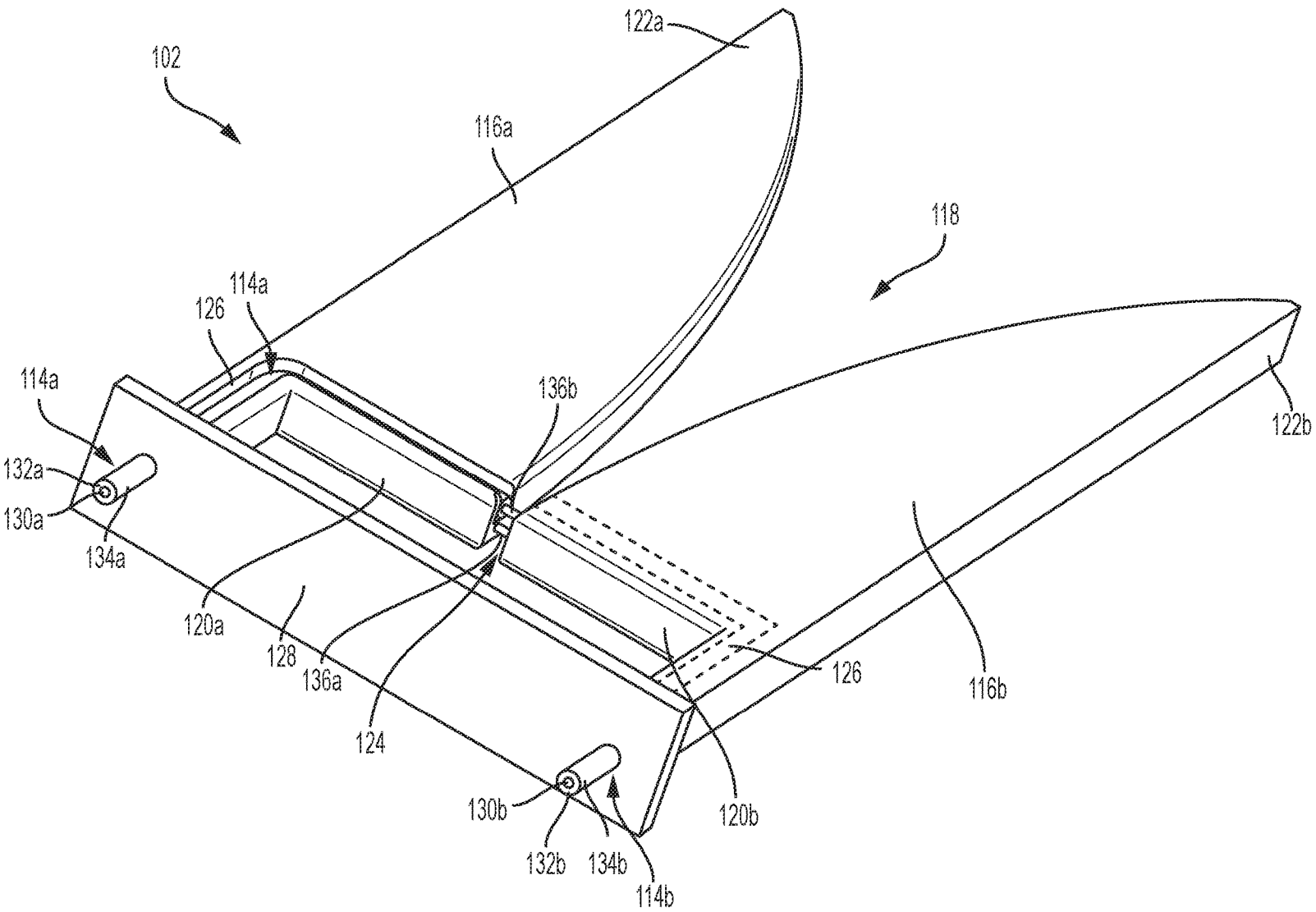
FIG. 2 illustrates a dual-feedline tapered slot antenna according to a non-limiting embodiment.

Turning now to FIG. 2, a dual-feedline tapered slot antenna 102 is illustrated according to a non-limiting embodiment. Various components of the dual-feedline tapered slot antenna 102 are described in detail above, and therefore will not be repeated for the sake of brevity. Each flared conductor 116*a* and 116*b* includes a feedpath 126 formed at its lower end 120*a* and 120, respectively. The feedpath 126 can either be exposed or formed as a tunnel or inlet that extends through the body of a respective flared conductor 116*a* and 116*b*. Each feedpath 126 begins at a base of the dual-feedline tapered slot antenna 102, and extends parallel with the outer edge of a respective flared conductor 116*a* and 116*b*. At an area located around the lower end 120*a* and 120*b*, the feedpath turns about ninety-degrees, and extends horizontally along the lower end where it reaches the slotline gap 124.

The feed lines 114*a* and 114*b* are fed through the base 128 and into a respective feedpath 126, where they follow the feedpath direction. In at least one embodiment, the feedlines 114*a* and 114*b* are constructed as coaxial waveguides 114*a* and 114*b*. The coaxial waveguides 114*a* and 114*b* have respective center conductors 130*a* and 130*b*, which are concentrically surrounded by respective sleeves 132*a* and 132 composed of a dielectric material such as Polytetrafluoroethylene, for example. The sleeves 132*a* and 132 are each surrounded by an outer shielding 134*a* and 134*b*.

The second end of each coaxial waveguide 114*a* and 114*b* includes an extended portion 136*a* and 136*b* of the center conductor 130*a* and 130*b*, which extends horizontally across the slotline gap 124. Each extended portion 136*a* and 136*b* is received within an opposite facing flared conductor 116*a* and 116*b*. For example, the first coaxial waveguide 114*a* extends through the first feedpath 114*a* of the first flared conductor 116*a* until the second end reaches the slotline gap 124. The extended portion 136*a* of its center conductor 130*a* extends across the slotline gap 124 and is received in a receptacle (not shown in FIG. 2) formed in the opposing second flared conductor 116*b*. Similarly, the second coaxial waveguide 114*b* extends through the second feedpath 114*a* of the second flared conductor 116*b* until the second end reaches the slotline gap 124. The extended portion 136*b* of its center conductor 130*b* extends across the slotline gap 124 and is received in a receptacle formed in the opposing first flared conductor 116*a*. The center conductors 130*a* and 130*b* are the only portions of each coaxial waveguide 114*a* and 114*b* that extend across slotline gap 124. The extended portions 136*a* and 136*b* can be secured to respective flared conductors 116*b* and 116*a* using solder, for example, so as to electrically couple the flared conductor 116*a* and 116*b* to the respective extended portion 136*b* and 136*a*.

In at least one embodiment, the outer shielding 134*a* and 134*b*, along with the insulating sleeves 132*a* and 132*b* are trimmed so that only the center conductor 136*a* and 136*b* extends through the slotline region (e.g., across the slotline gap 124) to be electrically connected to the opposite-facing flared conductor 116*b* and 116*a*. The outer shielding 134*a* and 134*b* can be electrically connected to its near-side flared conductor 116*a* and 116*b*. Metal brackets or cable clamps (not shown in FIG. 2) may be implemented to clamp the coaxial waveguides 114*a* and 114*b* in place, at the same time forming extensions of the flared conductors 116*a* and 116*b*. A dielectric filler (not shown in FIG. 2) can then be bonded in place using a resin with similar electrical properties. The resin fills any air gaps around the center conductors 130*a* and 130*b*.

The first coaxial waveguide 114*a* includes a first end connected to an output of the first transmission amplifier 112*a* (not shown in FIG. 2), and a second end disposed adjacent the slotline gap 124. Similarly, the second coaxial waveguide 114*b* includes a first end connected to an output of the second transmission amplifier 112*b* (not shown in FIG. 2) and a second end disposed adjacent the slotline gap 124. Thus, the second end of the first coaxial waveguide is disposed on a first side of the slotline gap 124, while the second end of the second coaxial waveguide is disposed on the opposite side of the slotline gap 124. As described above, however, this arrangement is not present in the case where the first and second coaxial waveguides are fed to the same side of the dual-feedline tapered slot antenna 102, i.e., are fed to a common flared conductor 116*a* or 116*b*.

Figure 3C:
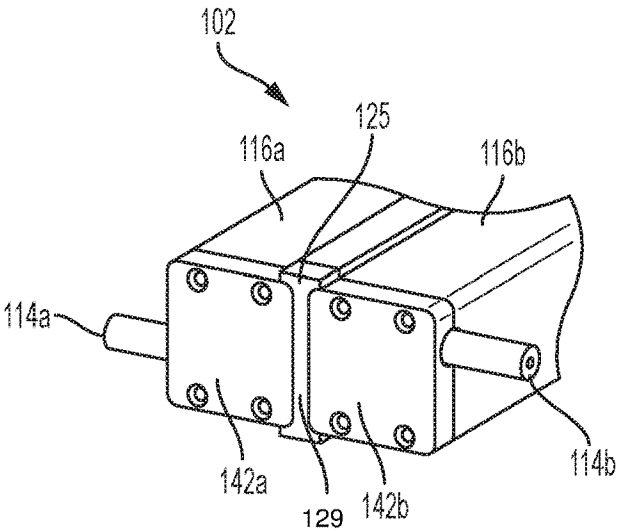
FIGS. 3A, 3B and 3C are a series of views illustrating an installation of a plurality of feedlines in a dual-feedline tapered slot antenna according to a non-limiting embodiment.
Figure 3B:
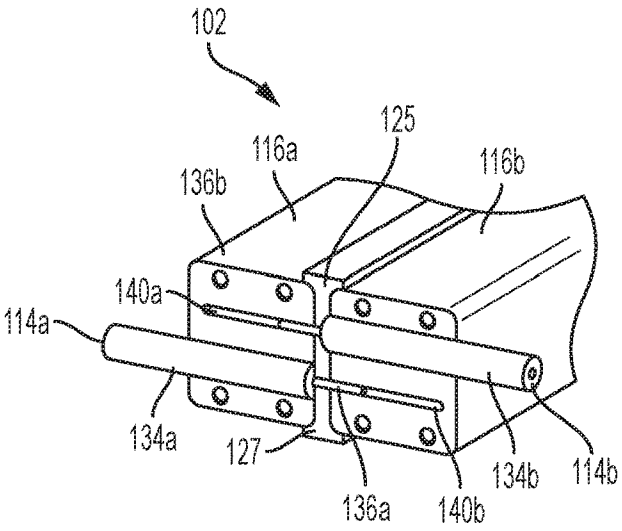
Figure 3A:
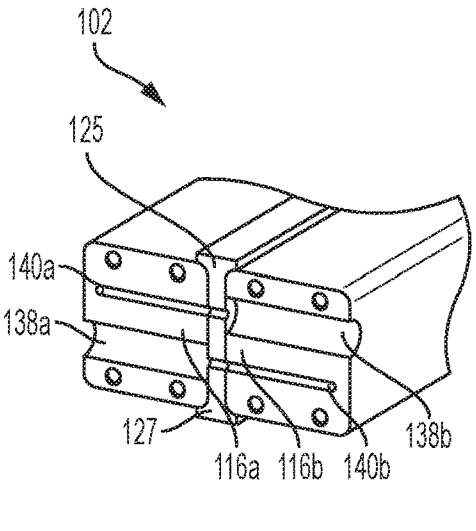

FIG. 3 illustrates an assembly that prevents the formation of blind connections. Instead, the metal surfaces to be mated are accessible and visible for soldering or welding, and the dielectric surfaces are accessible and visible for application of a bonding resin. The installation of a plurality of feedlines 114*a* and 114*b* in a dual-feedline tapered slot antenna 102 is illustrated according to a non-limiting embodiment. In the example, the feedlines 114*a* and 114*b* are constructed as coaxial waveguides, and are input to opposing flared conductors 116*a* and 116*b* of the dual-feedline tapered slot antenna 102 as illustrated in FIG. 3B. Structural details of the coaxial waveguides 114*a* and 114*b* are described in detail above, and therefore will not be repeated for the sake of brevity.

The first and second flared conductors 116*a* and 116*b* are separated from one another by a slotline region 125. In some embodiments, the slotline region 125 exists as an air gap that defines the slotline gap 124 described above. In at least one embodiment illustrated in FIG. 3, the slotline region 125 contains a dielectric filler 127 that fills the slotline gap located in the slotline region 125. The dielectric filler 127 can be composed of a dielectric material having high breakdown strength and low radio frequency loss, such as those listed previously.

The first and second flared conductors 116*a* and 116*b* each include outer shielding receptacles 138*a* and 138*b*, along with center conductor receptacles 140*a* and 140*b*. The outer shielding receptacles 138*a* and 138*b* are sized to receive the outer shielding 134*a* and 134*b*, respectively, while the center conductor receptacles 140*a* and 140*b* are sized smaller to receive the extended portion 136*a* and 136*b* of respective center conductors. The center conductor receptacle 140*a* formed in the first flared conductor 116*a* is horizontally aligned with the outer shielding receptacle 138*b* formed in the second flared conductor 116*b*. Similarly, the center conductor receptacle 140*b* formed in the second flared conductor 116*b* is horizontally aligned with the outer shielding receptacle 138*a* formed in the first flared conductor 116*a*.

Referring to FIG. 3B, the first coaxial waveguide 114*a* is attached so that its outer shield 134*a* meets the outer shielding receptacle 138*a* and its inner conductor 136*a* meets the center conductor receptacle 140*b* and a recess in the dielectric filler 127. Similarly, the second coaxial waveguide 114*b* is attached so that its outer shield 134*b* meets the outer shielding receptacle 138*b* and its inner conductor 136*a* meets the center conductor receptacle 140*b* and a recess in the dielectric filler 127.

Turning now to FIG. 3C, cable clamps 142*a* and 142*b* are fastened against the lower ends of the first and second flared conductors 116*a* and 116*b* to clamp the coaxial waveguides 114*a* and 114*b* in place. The cable clamps 142*a* and 142*b* also form an extension at the lower ends of the flared conductors 116*a* and 116*b*, while having a thickness that achieves a co-planar front surface with respect to the dielectric insert 129. In at least one embodiment, the cable clamps 142*a* and 142*b* can be composed of the same material (e.g., metal) as that of the first and second flared conductors 116*a* and 116*b*. The insert 129 can be of the same dielectric material as 127, and shaped so that it forms an extension of 127 and can be bonded in place using a compatible resin adhesive.

Figure 4B:
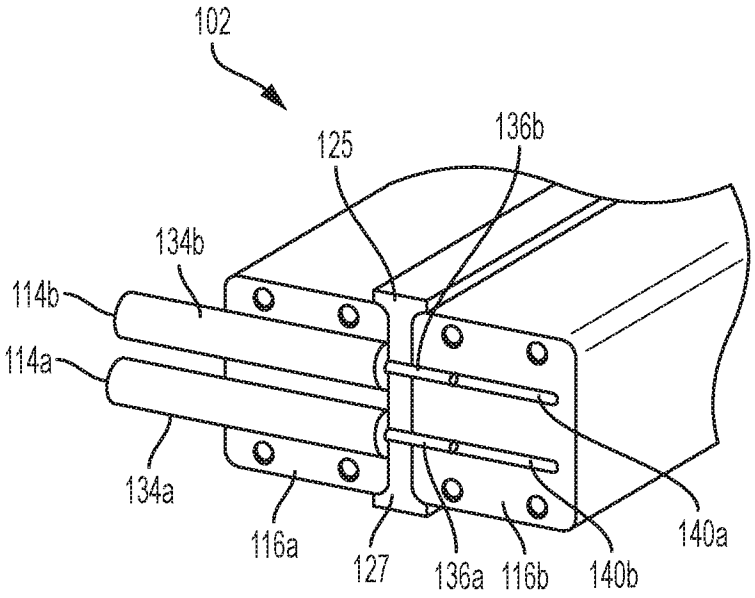
FIGS. 4A and 4B are a series of views illustrating an installation of a plurality of feedlines in a dual-feedline tapered slot antenna according to another non-limiting embodiment.
Figure 4A:
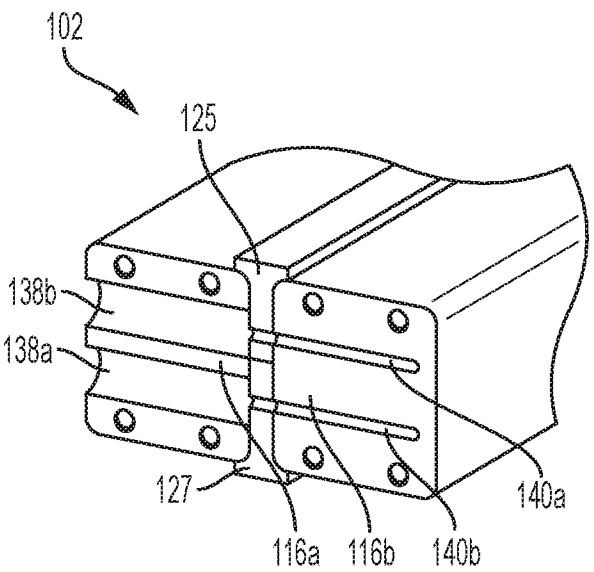

The installation of a plurality of feedlines 114*a* and 114*b* in a dual-feedline tapered slot antenna 102 is illustrated in FIGS. 4A and 4B according to another non-limiting embodiment. In this example, a pair of outer shielding receptacles 138*a* and 138*b* are formed on a common side of the dual-feedline tapered slot antenna 102 as illustrated in FIG. 4A. Accordingly, the coaxial waveguides 114*a* and 114*b* can be attached to a common flared conductor (e.g., the first flared conductor 116*a*). That is, the first and second coaxial waveguides 114*a* and 114*b* are attached to a same side of the dual-feedline tapered slot antenna 102. To facilitate the same-side feedline input, the first flared conductor 116*a* includes a first outer shielding receptacle 138*a* and a second outer shielding receptacle 138*b*. The second flared conductor 116*b* includes a first center conductor receptacle 140*a* and a second center conductor receptacle 140*b*. The first and second center conductor receptacles 140*a* and 140*b* are horizontally aligned with respective shielding receptacles 138*a* and 138*b*.

Referring to FIG. 4B, the first coaxial waveguide 114*a* is attached so that its outer shield 134*a* meets the outer shielding receptacle 138*a* and its inner conductor 136*a* meets the center conductor receptacle 140*b* and a recess in the dielectric filler 127. Similarly, the second coaxial waveguide 114*b* is attached so that its outer shield 134*b* meets the outer shielding receptacle 138*b* and its inner conductor 136*a* meets the center conductor receptacle 140*b* and a recess in the dielectric filler 127.

As described above, various non-limiting embodiments provide a tapered slot antenna including dual power-combining feedlines. Unlike conventional tapered slot antennas having only a single feedline, at least one embodiment implements two individual feedlines (e.g., two individual coaxial waveguides) in a single tapered slot antenna. The dual feedlines deliver feed signals having either a mismatched phase (e.g., 180 degrees out-of-phase) or a matched phase, so as to reduce or even eliminate the level of signal reflection returned back to the transmitting amplifiers which output the feed signals.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An antenna transmission system comprising:

a dual-feedline tapered slot antenna configured to generate a radiated output signal in response to a radio frequency (RF) signal;

a power divider configured to split a source RF signal into a plurality of RF feed signals;

a plurality of transmitting amplifiers configured to convert the plurality RF feed signals into a plurality of amplified RF feed signals; and first and second feedlines configured to deliver the plurality of amplified RF feed signals to the dual-feedline tapered slot antenna, wherein the dual-feedline tapered slot antenna generates the radiated output signal in response to the plurality of amplified RF feed signals, and wherein the dual-feedline tapered slot antenna includes a first flared conductor and a second flared conductor arranged opposite the first flared conductor, the first and second flared conductors separated from one another by a slotline region having a nominal impedance that is one half that of the first and second feedlines.

2. The antenna transmission system of claim 1, wherein the plurality of transmission amplifiers includes a first transmission amplifier that outputs a first amplified RF feed signal to the first feedline, and a second transmission amplifier that outputs a second amplified RF feed signal to the second feedline.

3. The antenna transmission system of claim 2, wherein the first flared conductor receives the first feedline and the second flared conductor receives the second feedline.

4. The antenna transmission system of claim 3, wherein the first amplified RF feed signal has a first phase ($\theta_1$), and the second amplified RF feed signal has a second phase ($\theta_2$) that is shifted to be mismatched with respect to the first phase ($\theta_1$).

5. The antenna transmission system of claim 4, wherein the second phase ($\theta_2$) is shifted 180 degrees with respect to the first phase ($\theta_1$).

6. The antenna transmission system of claim 2, wherein one of the first flared conductor or the second flared conductor receives both the first feedline and the second feedline.

7. The antenna transmission system of claim 6, wherein the first amplified RF feed signal has a first phase ($\theta_1$), and the second amplified RF feed signal has a second phase ($\theta_2$) that matches the first phase ($\theta_1$).

8. The antenna transmission system of claim 2, wherein the first and second feedlines are coaxial waveguides, and wherein the slotline region includes a dielectric material disposed therein.

9. A dual-feedline tapered slot antenna comprising:

a first flared conductor and a second flared conductor separated from the first flared conductor by a slot region;

a first feedline receptacle configured to receive a first feedline, the first feedline configured to deliver a first RF feed signal to the dual-feedline tapered slot antenna; and a second feedline receptacle configured to receive a second feedline, the second feedline configured to deliver a second RF feed signal to the dual-feedline tapered slot antenna, wherein a nominal impedance of the slotline region is about one half the nominal impedance of the first and second feedlines.

10. The dual-feedline tapered slot antenna of claim 9, wherein the first flared conductor comprises:

a first outer shielding receptacle having a first size, and configured to receive a first outer shielding of the first feed line; and a second outer shielding receptacle having the first size, and configured to receive a second outer shielding of the second feed line, and wherein the second flared conductor comprises:

a first center conductor receptacle having a second size that is smaller than the first size, and configured to receive a first center conductor of the first feed line while blocking reception of the first outer shielding; and a second center conductor receptacle having the second size, and configured to receive a second center conductor of the second feed line while blocking reception of the second outer shielding.

11. The dual-feedline tapered slot antenna of claim 9, wherein the first flared conductor comprises:

a first outer shielding receptacle having a first size, and configured to receive a first outer shielding of the first feed line; and a first center conductor receptacle having a second size that is smaller than the first size, and configured to receive a center conductor of the second feed line while blocking reception of an outer shielding of the second feed line, and wherein the second flared conductor comprises:

a second outer shielding receptacle having the first size, and configured to receive the outer shielding of the second feed line, and a second center conductor receptacle having the second size, and configured to receive a center conductor of the first feed line while blocking reception of the outer shielding of the first feed line.

12. A method of transmitting a signal from a dual-feedline tapered slot antenna, the method comprising:

generating, via a signal source, a radio frequency (RF) signal;

splitting the RF signal into a first feed signal and a second feed signal;

amplifying the first feed signal to generate a first amplified feed signal, and amplifying the second feed signal to generate a second amplified feed signal;

delivering the first amplified feed signal via a first line to a first flared conductor of the dual-feedline tapered slot antenna and the second amplified feed signal via a second feedline to a second flared conductor of the dual-feedline tapered slot antenna arranged opposite the first flared conductor, the first and second flared conductors separated from one another by a slotline region having a nominal impedance that is one half that of the first and second feedlines; and combining the first and second amplified feed signals to electrically energize the dual-feedline tapered slot antenna and transmit the signal.

13. The method of claim 12, wherein delivering the first and second amplified feed signals comprises delivering the first and second amplified feed signals to opposite sides of the dual-feedline tapered slot antenna.

14. The method of claim 13, wherein delivering the first and second amplified feed signals further comprises:

delivering the first amplified feed signal to a first flared conductor of the dual-feedline tapered slot antenna; and delivering the second amplified feed signal to a second flared conductor of the dual-feedline tapered slot antenna, the second flared conductor disposed opposite from the first flared conductor.

15. The method of claim 14, further comprising delivering the first amplified feed signal at first phase, and delivering the second amplified feed signal at second phase different from the first phase.

16. The method of claim 15, wherein the second phase is shifted 180 degrees out-of-phase with respect to the first phase.

17. The method of claim 12, wherein delivering the first and second amplified feed signals comprises delivering the first and second amplified feed signals to a same side of the dual-feedline tapered slot antenna.

18. The method of claim 17, wherein delivering the first and second amplified feed signals further comprises:

delivering the first amplified feed signal to a first flared conductor of the dual-feedline tapered slot antenna; and delivering the second amplified feed signal to the first flared conductor of the dual-feedline tapered slot antenna.

19. The method of claim 18, further comprising delivering the first amplified feed signal at a first phase, and delivering the second amplified feed signal at second phase that matches the first phase.

* * * * *